US006427507B1

(12) United States Patent
Hong et al.

(10) Patent No.: US 6,427,507 B1
(45) Date of Patent: Aug. 6, 2002

(54) APPARATUS FOR MEASURING THE STRIP FLATNESS

(75) Inventors: Wan-Kee Hong, Kyungju; Joon-Jeong Yi, Pohang, both of (KR)

(73) Assignees: Pohang Iron & Steel Co., Ltd.; Research Institute of Industrial Science & Technology, both of Kyungsangbuk-do (KR)

( * ) Notice: Subject to any disclaimer, the term of this patent is extended or adjusted under 35 U.S.C. 154(b) by 0 days.

(21) Appl. No.: 09/786,044

(22) PCT Filed: Jul. 15, 2000

(86) PCT No.: PCT/KR00/00771

§ 371 (c)(1),
(2), (4) Date: Feb. 28, 2001

(87) PCT Pub. No.: WO01/05530

PCT Pub. Date: Jan. 25, 2001

(30) Foreign Application Priority Data

Jul. 15, 1999 (KR) ..... 99-28774

(51) Int. Cl.[7] ..... B21B 37/28

(52) U.S. Cl. ..... 72/9.1; 72/11.7; 73/862.07; 73/862.55

(58) Field of Search ..... 72/8.3, 8.9, 9.1, 72/11.1, 11.6, 11.7, 12.7; 73/862.07, 862.451, 862.471, 862.472, 862.55

(56) References Cited

U.S. PATENT DOCUMENTS

| | | | | | |
|---|---|---|---|---|---|
| 3,334,508 | A | * | 8/1967 | Martin | 72/9.1 |
| 3,788,534 | A | * | 1/1974 | Shumaker | 226/4 |
| 4,512,170 | A | * | 4/1985 | Hsu | 72/11.7 |
| 4,771,622 | A | * | 9/1988 | Ginzburg | 72/9.1 |
| 4,972,706 | A | * | 11/1990 | Adolfsson et al. | 73/159 |

FOREIGN PATENT DOCUMENTS

| | | | |
|---|---|---|---|
| JP | 60-3907 | 1/1985 | B21B/37/00 |
| JP | 2-27212 | 1/1990 | G01B/21/30 |
| JP | 6-269811 | 9/1994 | B21B/13/14 |

* cited by examiner

*Primary Examiner*—Ed Tolan
(74) *Attorney, Agent, or Firm*—Fish & Richardson P.C.

(57) ABSTRACT

The present invention provides an apparatus for measuring flatness of a hot rolled strip based on a contact load of the hot rolled strip to split rolls of a looper in the hot rolling process. The split rolls are assembled in a bracket such that each split roll can be separated from the bracket. A normal-movement control unit for moving the split rolls in the normal direction, and a tangent-movement control unit for moving the split rolls in the tangent direction are porvided at a side of the bracket bearing the split rolls. An impact absorption unit is mounted at a support that is movably connected to the tangent-movement control unit. A pre-pressure application unit is provided at the support to prevent a sensor cap and a load sensor from being released. A heat-shielding ring surrounds the load sensor to prevent the load sensor from being overheated.

14 Claims, 7 Drawing Sheets

APPARATUS FOR MEASURING THE STRIP FLATNESS

This application is a 35 USC 371 of PCT/KR00/00771 filed Jul. 15, 2000.

BACKGROUND OF THE INVENTION (a) Field of the Invention

The present invention relates to an apparatus for measuring flatness of hot rolled strips in a rolling mill and, more particularly, to a contact-typed strip flatness measuring device which protects load sensors from heat or impact while controlling surface points of split rolls to move up and down.

(b) Description of the Related Art

Generally, metal strips produced through hot-rolling slabs should be kept to be even in flatness along the width thereof.

An automatic shape controller based on a shapemeter has been frequently employed for use in controlling the strip flatness during the hot rolling process. FIG. 1 illustrates a rolling mill with such an automatic shape controller. In the automatic shape controller, a shapemeter 1 measures the shape change in the target hot rolled strip S through generating laser, and detects the strip flatness based on the measured shape change. The detected value of the strip flatness is input into a calculator 4 that calculates a control value. Then, depending upon the control value, a bender controlling unit 5 controls pressure of a bender 2 installed at the last stand, thereby controlling the strip flatness.

However, in the above strip flatness control technique, the strip flatness is basically controlled by taking the shape change of the hot rolled strip S as a criterion, and such a shape change largely differs from the practical value of strip flatness. Therefore, in such a technique, the strip flatness cannot be measured in a correct manner. Furthermore, when the frontal end portion of the hot rolled strip S transported over a roller table 3 is coiled around a coiler 6, the hot rolled strip S is flattened under strain due to the difference in relative speeds between the last stand B and the coiler 6. Accordingly, the shapemeter 1 cannot measure the strip flatness after the hot rolled strip S is coiled around the coiler 6.

In order to solve such problems, a contact-type strip flatness measuring device has been suggested. In the device, the strip flatness is measured through detecting reduction in the hot rolled strip while directly contacting it.

Split looper rolles are arranged along the width of the hot rolled strip S, and a load sensor is attached to each split roll to detect load distribution of the hot rolled strip S. The detected load distribution is converted to a value of strip flatness, and makes feedback to a flatness control system, thereby controlling flatness across the hot rolled strip S.

When the load distribution signal issued from the strip flatness measuring device makes feedback to the flatness control system on line, uniform flatness can be obtained over the entire length of the hot rolled strip S.

However, such a contact-type load distribution measuring device should perform its intrinsic functions in poor working conditions such as high temperature, high humidity, and high vibration. Furthermore, it should ensure sufficient device stability and reliability, and detect the load distribution in a stable manner.

FIG. 2 illustrates a contact-type strip flatness measuring device installed at the Hoesch steel mill of German (Herman J. Kopineck, "Rolling of hot strips with controlled Tension and Flatness," Hot strip profile and flatness seminar, Nov. 2–3, 1988, Pittsburg Pa.). As shown in FIG. 2, a load sensor 12 is provided at an end portion of a support 11 bearing a split roll 10 to detect the load applied to the split roll 10, thereby measuring the strip flatness.

However, in such a device, since the difference in the maximum loads at tension and compression (hereinafter referred to as the "peak load") is so great that the load sensor 12 is liable to be broken at repeated sensing operations, resulting in lowered precision and reduced device life span.

FIG. 3 illustrates another contact-type measuring device disclosed by George. F. Kelk in "New developments improve hot strip: Shapemeter-Looper and Shape Actimeter", Iron and Steel Eng., August, 1986, pp. 48–56. As shown in FIG. 3, a compression-type load sensor 22 is provided at the bottom side of a shaft support 21 bearing a split roll 20. In this structure, the tensile load applied to the split roll 20 does not influence the load sensor 22 so that the peak load can be reduced. However, since the strip flatness measuring device should play its intrinsic functions as a looper before it detects the load applied to the hot rolled strip S along the width thereof, the looper excessively moves up and down when uneveness in mass between the neighboring stands is present due to the great difference in relative speeds between the stands. In this case, the looper collides with an upper or lower damper so that strong impact is applied to the strip flatness measuring device, resulting in reduced life span of the load sensor 22.

In this connection, a stopper 23 is provided at the strip flatness measuring device to prevent the load sensor 22 from being applied with an over-load.

However, when the maximum load is applied to the load sensor 22, the compressed displacement is too small to make sufficient distance for preventing the load sensor 22 from being applied with the over-load. Thus, the mechanical means of protecting the load sensor 22 based on the stopper 23 has a limit in application in that whenever the device suffers slight deformation, the stopper 23 should be controlled each time.

Furthermore, the strip flatness measuring devices shown in FIGS. 2 and 3 are interposed between the rolling stands, and the temperature of the hot rolled strips S amounts to 800 to 1200° C. In these conditions, the load sensor extremely sensitive to heat should be protected from the heat in a stable manner. If not, errors in meaurement are inevitably followed by.

For that reason, a cooling nozzle 24 is provided at the strip flatness measuring device to spray cooling water to the load sensor 22. However, in case the spraying of the cooling water becomes poor due to breakage or alien materials, there is a problem in that the preparation for such a case is absent.

Furthermore, the hot rolled strips are differentiated in the load distribution depending upon their shapes. Therefore, when the strip flatness measuring device is used for a long time, the plural numbers of split rolls 10 and 20 are rubbed in a different manner so that they become differentiated in horizontal height, and errors in detection with respect to the load applied thereto are made.

In order to solve such a problem, the strip measuring device shown in FIG. 2 is provided with a height control bolt 13 for controlling the tangent-movement thereof around a rotation shaft 14, and the strip measuring device shown in FIG. 3 with a wedge-shaped control member 25 for controlling the tangent-movement.

However, in such a case, as shown in FIG. 4A, deviation in rubbing dR between the split rolls 10 and 20 is made.

Even though such a deviation in rubbing is controlled, as shown in FIG. 4B, deviance in controlling dR' is present so that the load sensors 12 and 22 for detecting the load applied to the hot rolled strip S incorrectly detect such a load while making serious errors in the flatness detection signal. That is, in the one-directional control technique, the horizontal height of the measuring device cannot be controlled in a correct manner.

Meanwhile, in case the rubbed split rolls should be repaired or replaced by a new one, long repair or replacement time is required, lowering productivity.

SUMMARY OF THE INVENTION

It is an object of the present invention to provide a strip flatness measuring device which can protect a load sensor from the external factors, and control the relative heights between split rolls while securing precesion in measurement.

This and other objects may be achieved by a strip flatness measuring device including a looper with a plurality of split rolls. The split rolls are assembled in a bracket such that each split roll can be separated from the bracket. A normal-movement control unit for moving the split rolls in the normal direction, a tangent-movement control unit for moving the split rolls in the tanget direction are provided at a side of the bracket. A support is movably connected to the tanget-movement control unit, and an impact absorption unit is installed at the support. A sensor cap is installed at a side of the support while pressurizing a load sensor. A pre-pressure application unit is provided between the support and a base of the looper to previously compresses the sensor cap against the load sensor, thereby preventing the load sensor from being released from the sensor cap.

In the above structure, even though deviation in rubbing occurs at the split rolls, the normal-movement control unit and the tangent-movement control units can precisely control the relative heights between the split rolls.

Furthermore, the load sensor is protected from the external impacts by way of the impact absorption unit and the pre-pressure application unit so that it can detect load distribution in a stable manner. The load sensor is also protected from the heat through mounting a heat-shielding ring around the load sensor.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or the similar components, wherein.

DETAILED DESCRIPTION OF THE PREFERRED EMBODIMENTS

Preferred embodiments of this invention will be explained with reference to the accompanying drawings.

Figure 1:
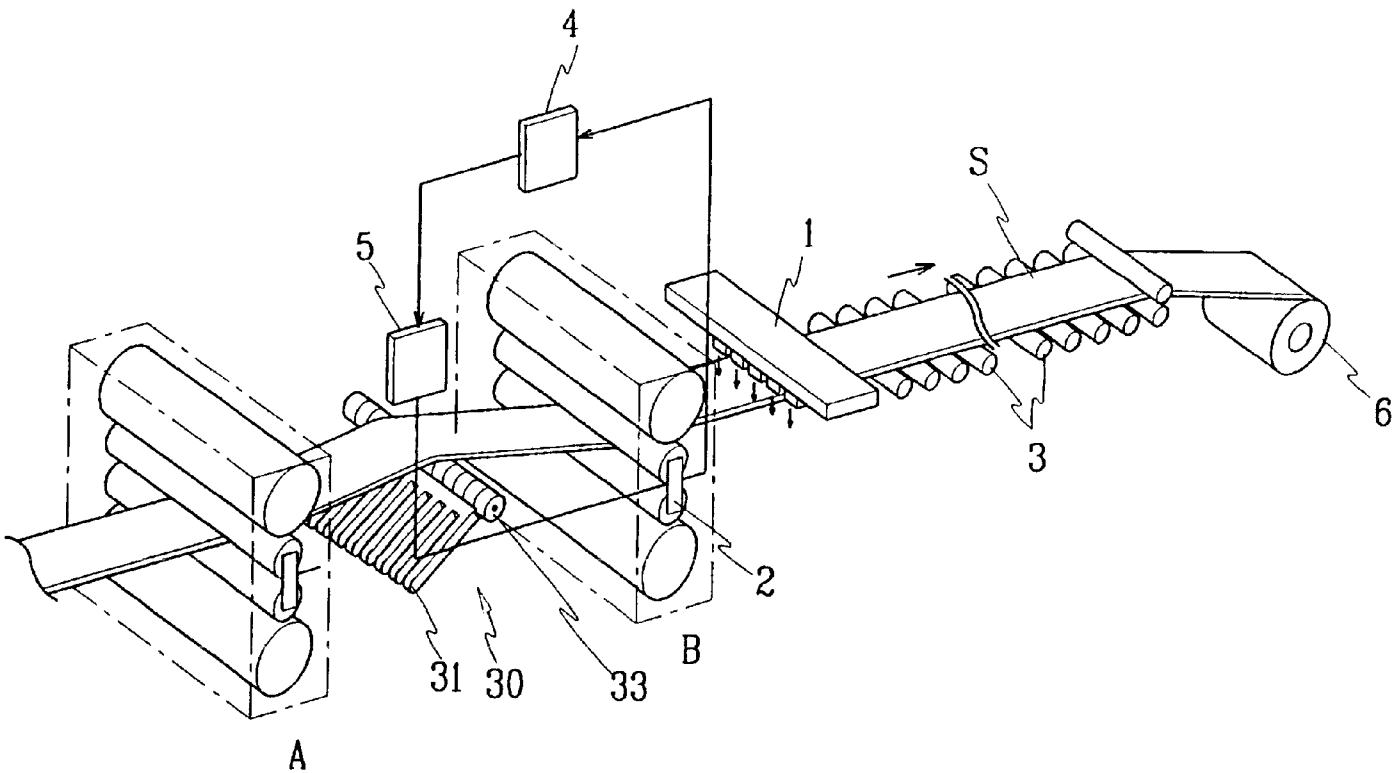
FIG. 1 is a perspective view of a rolling mill with a usual strip flatness measuring device.
Figure 2:
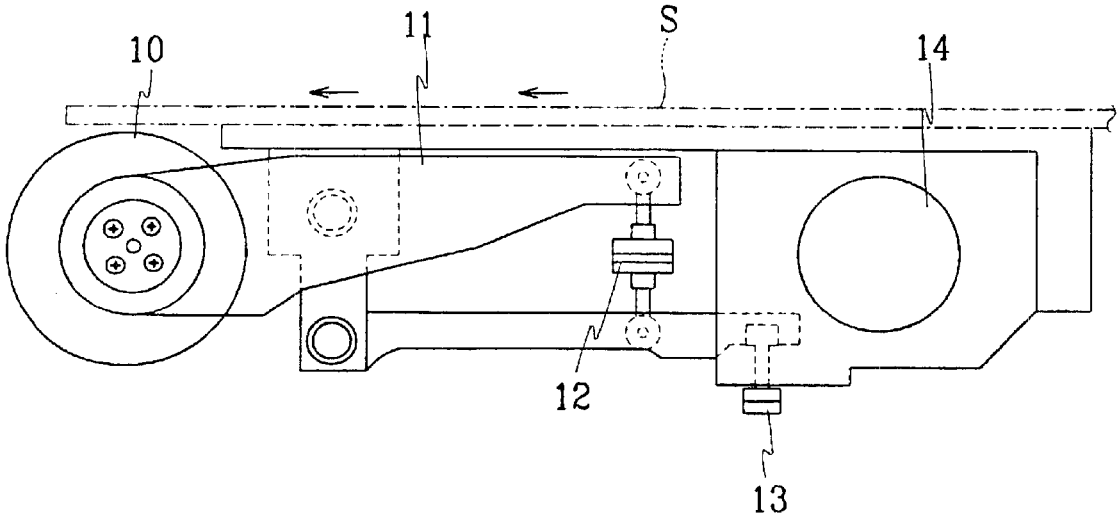
FIG. 2 is a side view of a contact-type strip flatness measuring device according to a prior art.
Figure 3:
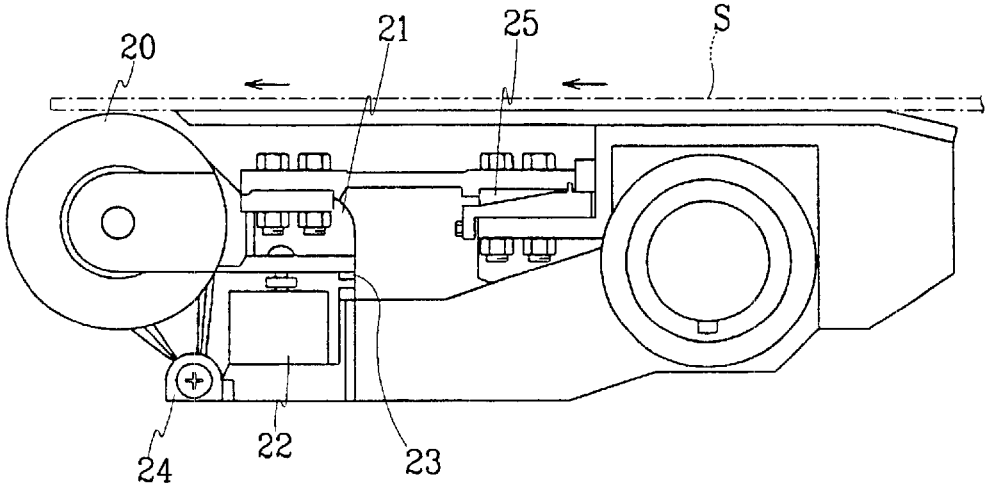
FIG. 3 is a side view of a contact-type strip flatness measuring device according to another prior art.
Figure 4A:
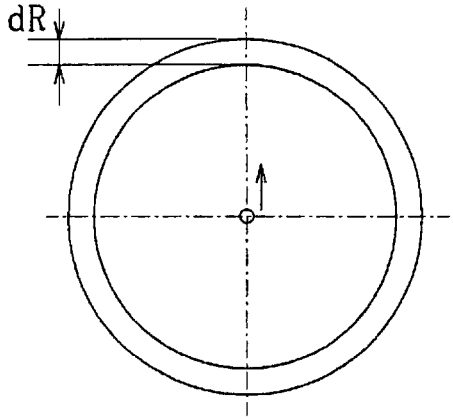
FIGS. 4A and 4B illustrate the technique of compensating deviation in rubbing occurred at split rolls in the contact-type strip flatness measuring devices shown in FIGS. 2 and 3.
Figure 4B:
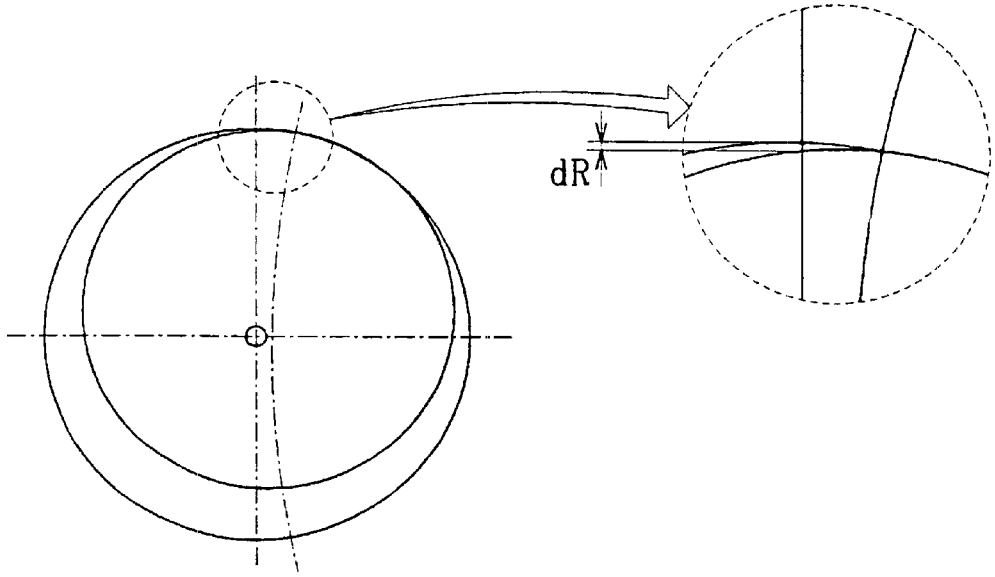

The strip flatness measuring device according to the present invention is provided at a looper 30 between the rolling mills A and B shown in FIG. 1. The looper 30 gives tension to the hot rolled strip S while rotating by 90 degree or less in the clockwise or anti-clockwise direction with respect to a rotation shaft 31. Looper rolls 33 are fixed at the end portion of the looper 30 such that they directly contact the hot rolled strip S. The looper rolls are segmented by two external dummy rolls, and three measuring rolls disposed between the dummy rolls to measure the load applied to the hot rolled strip S. The three measuring rolls will be hereinafter referred to as the "split rolls" 35.

Figure 5:
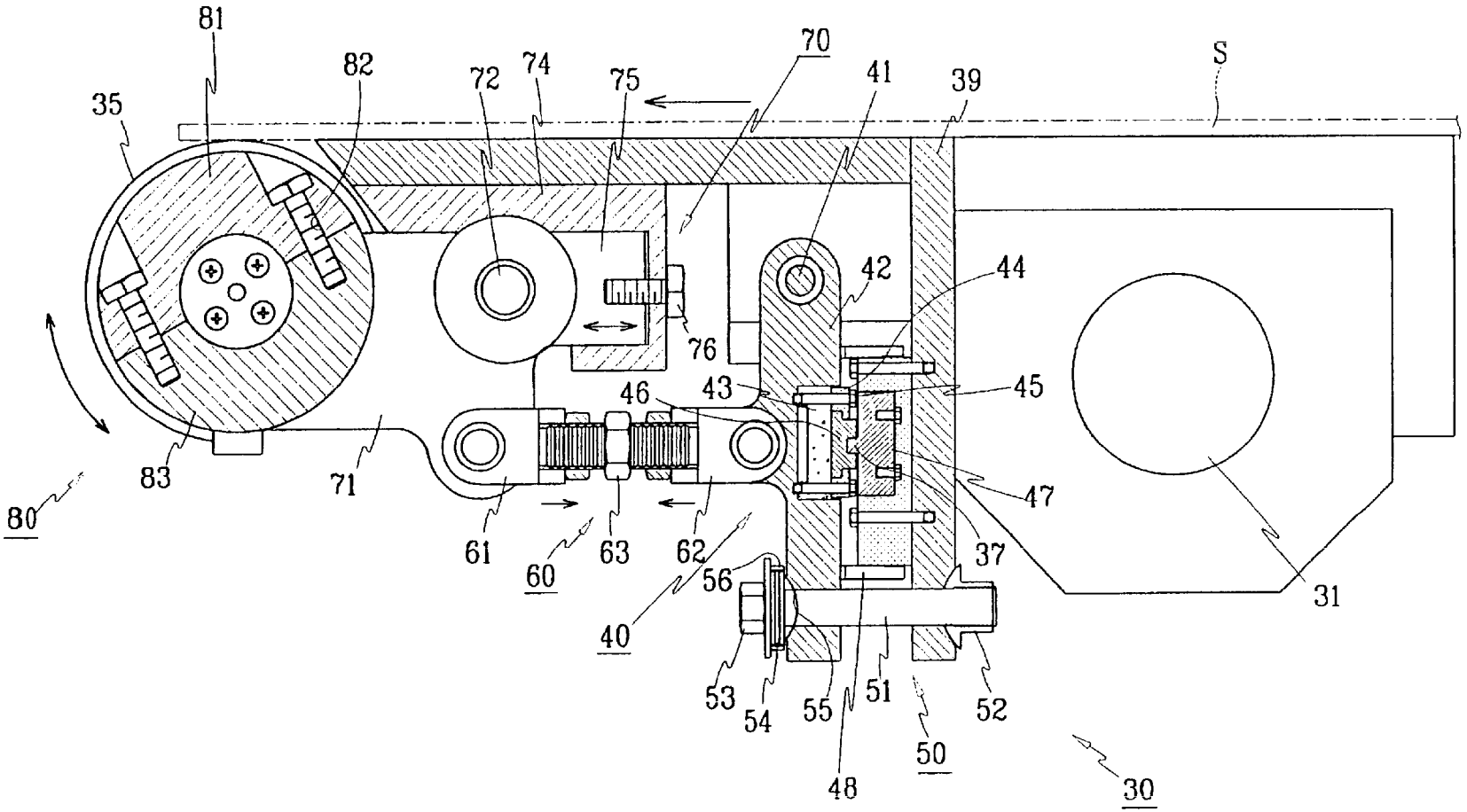
FIG. 5 is a cross sectional view of a contact-type strip flatness measuring device with a load sensor according to a preferred embodiment of the present invention.

FIG. 5 is a cross sectional view of a contact-type strip flatness measuring device according to a preferred embodiment of the present invention.

As shown in FIG. 5, the contact-type strip flatness measuring device roughly includes an impact absorption unit 40 for absorbing the impact applied to a load sensor 37, a pre-pressure application unit 50 for applying pressure to a sensor cap 46, a tangent-movement control unit 60 for moving the split rolls 35 up and down, a normal-movement control unit 70 for moving the split rolls 35 back and forth, and a split roll fixation unit 80 for fixing the split rolls 35.

The impact absorption unit 40 is installed at an inner groove of a support 42 that rotates around a support shaft 41. A cylindrical-shaped rubber pad 43 is fixed to the inner groove of the support 42 using bolts 45 via washers 44. The washers 44 have protrusions holding the sensor cap 46. The load sensor 37 for measuring the load applied to the split rolls 35 is fixed to a sensor block 47 that is in turn fixed to a base 39 with a cylindrical shape.

A heat-shielding ring 48 is externally screw-coupled to the sensor block 47 to protect the load sensor 37 from the heat at the hot rolling temperature of 800–1200° C. The heat-shielding ring 48 protects the load sensor 37 through filling up the gap between the sensor block 47 and the sensor cap 46. In addition, a usual cooler may be selectively provided at the strip flatness measuring device to cool it through spraying cooling water thereto.

A pre-pressure application unit 50 has a role of defining the rotation angle of the support 42 at a predetermined degree. The pre-pressure application unit 50 includes a bolt 51 coupling the end portion of the support 42 with the end portion of the base 39, a spherical nut 52 fixing the bolt 51 to the base 39, and a disk spring 54 inserted between the support 42 and a head 53 of the bolt 51. A spherical groove 55 is formed at the side of the support 42 contacting the disk spring 54. A stopper 56 is coupled to the bolt head 53 to control the rotation angle of the support 42.

A tangent-movement control unit 60 turns a bracket 71 fixing the shaft of the split rolls 35 around a bracket shaft 72 up and down. The tangent-movement control unit 60 includes a left clevis 61 rotatably coupled to the bracket 71, a right clevis 62 rotatably coupled to the support 42, and a bidirectional control bolt 63. In this structure, when the control bolt 63 is locked or released, the left and right devises 61 and 62 become closer to each other, or distant from each other.

The normal-movement control unit 70 has a role of moving the bracket 71 fixing the shaft of the split rolls 35 left and right. The normal-movement control unit 70 includes a slide base 74 fixed to the body of the split rolls 35, a bracket slide 75 coupled to the bracket 71, and a control bolt 76 for controlling the movement range of the bracket slide 75 left and right. The bracket 71, and the bracket slide 75 are rotatably fixed around a bracket shaft 72 such that they move together. That is, when the bracket slide 75 moves left and right, the bracket 71 moves left and right. Whereas, when the bracket 71 is rotated, the bracket slide 75 does not rotate together.

The split roll fixture 80 has a role of making the split rolls 35 to be easily locked or released. The split roll fixture 80 couples two separate split roll fixing plates 81 with a bracket fixing plate 83 via fixation bolts 82.

In operation, when a hot rolled strip S passes over the split rolls 35, the load applied to the split rolls 35 compresses the split rolls 35. Such a compression power is transmitted to the load sensor 37 via the bracket 71, the tanget-movement control unit 60, and the support 42.

The plural numbers of split rolls 35 can be easily locked or released via the corresponding fixation bolts 82. Therefore, in case one of the split rolls 35 needs to be repaired, it can be instantly replaced by a new one.

When uneveness in mass between the rolling stands A and B occurs during the hot rolling process, the looper 30 moves up or down around the shaft 31. In case the looper 30 excessively moves down, it collides with the lower damper while applying impact to the strip flatness measuring device. In this situation, the load sensor 37 suffers momentary impact.

At this time, the impact absorption unit 40 absorbs the impact applied to the strip flatness measuring device. Therefore, the load sensor 37 can correctly measure the rolling reduction ratio of the hot rolled strip S transmitted up to the sensor cap 46.

Figure 6A:
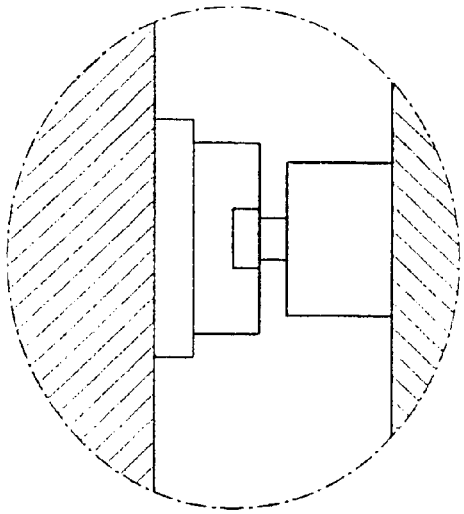
FIGS. 6A and 6B are amplified sectional views of the load sensor shown in FIG. 5.
Figure 6B:
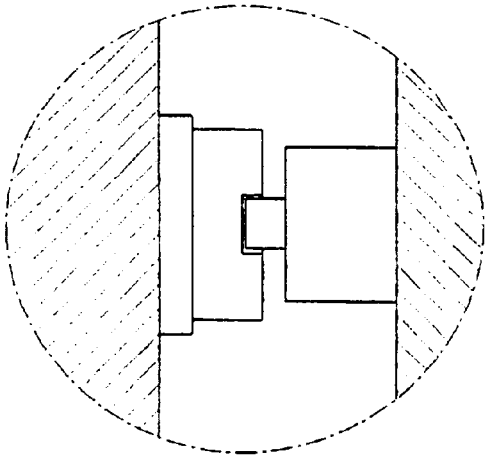

Meanwhile, when the looper 30 excessively moves up, and collides with the upper damper, as shown in FIG. 6A, the load sensor 37 is released from the sensor cap 46. When such a situation is repeated, the lock and release of the load sensor 37 into and from the sensor cap 46 are repeated. In this case, the load sensor 37 suffers repeated momentary impacts while being reduced in life span.

The pre-pressure application unit 50 solves such a problem. The pre-pressure application unit 50 previously compresses the support 42 against the base 39, thereby preventing the load sensor 37 from being released from the sensor cap 46 due to the impact applied to the looper 30. Therefore, even though a momentary impact is applied to the support 42, the load sensor 37 can correctly measure the applied load without being released from the sensor cap 46.

The hot rolled strip S passes over the looper 30 usually at the temperature range of 800–1200° C. and hence, the thermal-sensitive load sensor 37 is liable to be reduced in life span. In this connection, the heat-shilding ring 48 is disposed between the support 42 and the sensor block 47 to shield the heat directly applied to the load sensor 37. The heat-shilding ring 48 has a double structure while bearing a role of protecting the load sensor 37 from the heat as well as a role of functioning as a variable stopper.

The split rolls 35 suffers rubbing due to friction against the hot rolled strip S. Therefore, it is required that the height between the split rolls 35 should be periodically controlled in a correct manner.

The tangent-movement control unit 60 controls the relative heights between the split rolls 35, and the normal-movement control unit 70 controls the left and right distance between the split rolls 35.

Figure 7A:
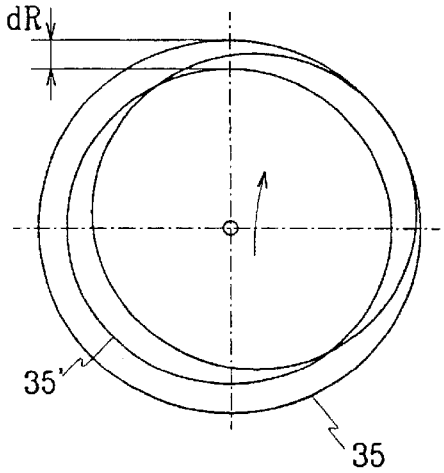
FIGS. 7A and 7B illustrate the technique of compensating deviation in rubbing occurred at split rolls in the contact-type strip flatness measuring device shown in FIG. 5.
Figure 7B:
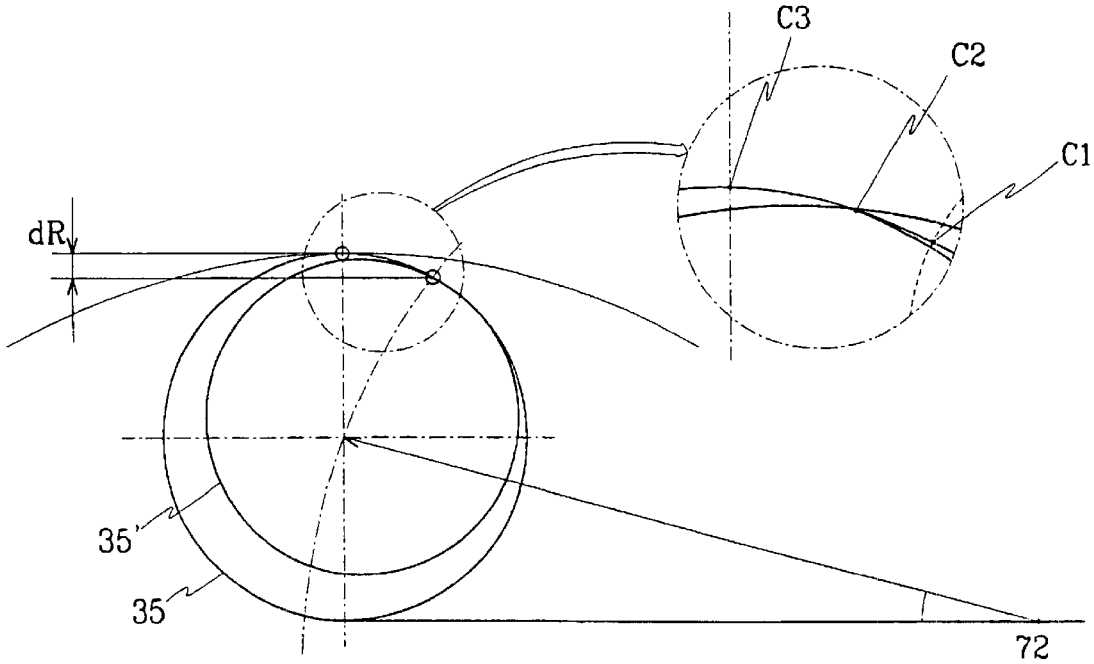

As shown in FIG. 7A, in case deviation in rubbing between the split roll 35 bearing higher rubbing ratio and the split roll 35 bearing lower rubbing ratio is present, as shown in FIG. 7B, the surface of the split roll 35 is controlled to move in the tanget direction using the bidirectional control bolt 63 of the tangent-movement control unit 60, and to move in the normal direction using the control bolt 76 of the normal-movement control unit 70. When the bidirectional control bolt 63 is controlled, the surface of the split roll 35 moves to the C1 point shown in FIG. 7B. In contrast, when the control bolt 76 is controlled, the surface of the split roll 35 moves to the C3 point. In case the surface point of the split roll is controlled only with the bidirectional control bolt 63, the maximum control point becomes to be the C2 point Accordingly, in order to control both surface points of the rubbed split roll 35' and the non-rubbed split roll 35, the tangent-movement control unit 60 and the normal-movement control unit 70 should be used together.

Meanwhile, when the sensor cap 46 returns to its initial state, the load sensor 37 senses the shape change of the hot rolled strip S in the upper direction, thereby correctly measuring the flatness of the hot rolled strip S.

The flatness of hot rolled strips S was measured through detecting correct distribution of the load applied to each split roll 35 and making feedback the detected values to the strip flatness control system. The results are given in Tables 1 and 2.

TABLE 1

(Comparison in flatness of strips with a width of 900-1100 mm)

| Top (%) | | Middle (%) | | Tail (%) | | Note Total numbers of collected strips |
|---|---|---|---|---|---|---|
| Before control | After control | Before control | After control | Before control | After control | before/after control |
| 25.1 | 47.2 | 24.9 | 57.4 | 19.9 | 55.0 | 382/322 |

TABLE 2

(Comparison in flatness of strips with a width of 1100–1350 mm)

| Top (%) | | Middle (%) | | Tail (%) | | Note Total numbers of collected strips |
|---|---|---|---|---|---|---|
| Before control | After control | Before control | After control | Before control | After control | before/after control |
| 78.0 | 96 4 | 77.0 | 93.9 | 67.8 | 91.9 | 469/591 |

As indicated in Tables 1 and 2, the hot rolled strips that were controlled based on the inventive strip flatness measuring device exhibited evenness in flatness over the entire length thereof.

While the present invention has been described in detail with reference to the preferred embodiments, those skilled in the art will appreciate that various modifications and substitutions can be made thereto without departing from the spirit and scope of the present invention as set forth in the appended claims.

What is claimed is:

1. A strip flatness measuring device for measuring a flatness of a hot rolled strip based on a contact load of the hot rolled strip applied to split rolls of a looper in the hot rolling process, the strip flatness measuring device comprising:

a tanget-movement control unit for controlling surface points of the split rolls while moving the split rolls up and down;

an impact absorption unit for preventing a load sensor from suffering the impact applied to the split rolls; and a pre-pressure application unit for pressurizing a support bearing a sensor cap against a base holding the load sensor at a predetermined pressure while coupling the base with the support, the base being fixed to the looper, the support being capable of rotating around a fixation shaft.

2. The strip flatness measuring device of claim 1 wherein the tangent-movement control unit comprises a bracket, a left clevis rotably coupled to the bracket, a right clevis rotatably coupled to the support, and a bidirectional control bolt screw-coupled to the left and right devises at bidirectionally screwed portions thereof.

3. The strip flatness measuring device of claim 1 wherein the impact absorption unit comprises an impact absorption member inserted into an inner groove of the support, bolts fixing the impact absorption member to the support via washers, and a sensor cap held by the washers.

4. The strip flatness measuring device of claim 1 wherein the pre-pressure application unit comprises a bolt coupling an end portion of the support with an end portion of the base, a spherical nut fixing the bolt to the base, and a disk spring disposed between a head of the bolt and the support.

5. The strip flatness measuring device of claim 4 wherein a spherical groove is formed at a side of the support contacting the disk spring, and a stopper is coupled to the head of the bolt.

6. The strip flatness measuring device of claim 1 further comprising a normal-movement control unit for controlling surface points of the split rolls while moving the split rolls left and right.

7. The strip flatness measuring device of claim 6 wherein the normal-movement control unit comprises a slide base fixed to a body of the looper, a bracket slide coupled to the bracket, and a control bolt controlling the movement range of the bracket slide in the left and right directions.

8. The strip flatness measuring device of claim 1 further comprising a heat-shielding unit for shielding the heat applied to the load sensor from the hot rolled strip.

9. The strip flatness measuring device of claim 8 wherein the heat-shielding unit is formed with a heat-shielding ring, the heat-shielding ring being externally coupled to a sensor block, the sensor block being fixed to the base while bearing the load sensor, the heat-shielding ring filling up the gap between the sensor cap and the sensor block.

10. The strip flatness measuring device of claim 1 further comprising a split roll fixture, the split roll fixture having a plurality of separate split roll fixing plates, a bracket fixing plate, and fixation bolts coupling the separate split roll fixing plates with the bracket fixing plate.

11. The strip flatness measuring device of claim 2 wherein the pre-pressure application unit comprises a bolt coupling an end portion of the support with an end portion of the base, a spherical nut fixing the bolt to the base, and a disk spring disposed between a head of the bolt and the support.

12. The strip flatness measuring device of claim 11 wherein a spherical groove is formed at a side of the support contacting the disk spring, and a stopper is coupled to the head of the bolt.

13. The strip flatness measuring device of claim 3 wherein the pre-pressure application unit comprises a bolt coupling an end portion of the support with an end portion of the base, a spherical nut fixing the bolt to the base, and a disk spring disposed between a head of the bolt and the support.

14. The strip flatness measuring device of claim 13 wherein a spherical groove is formed at a side of the support contacting the disk spring, and a stopper is coupled to the head of the bolt.

* * * * *